United States Patent [19]

Holland

[11] 4,276,804

[45] Jul. 7, 1981

[54] PITCH ADJUSTER FOR VALVED BRASS INSTRUMENTS

[76] Inventor: Jack O. Holland, 3314 W. End Ave., Nashville, Tenn. 37203

[21] Appl. No.: 47,143

[22] Filed: Jun. 11, 1979

[51] Int. Cl.[3] ..... G10D 9/00

[52] U.S. Cl. ..... 84/394

[58] Field of Search ..... 84/387–401

[56] References Cited

U.S. PATENT DOCUMENTS

| | | | |
|---|---|---|---|
| 550,967 | 12/1895 | Harris | 84/394 |
| 622,820 | 4/1899 | Neumann | 84/394 |
| 784,608 | 3/1905 | Wiser et al. | 84/388 |
| 828,273 | 8/1906 | Conn | 84/394 |
| 1,003,049 | 9/1911 | Jay | 84/387 |
| 1,061,885 | 5/1913 | Todt | 84/394 |
| 1,201,039 | 10/1916 | Gronert et al. | 84/394 |
| 1,218,057 | 3/1917 | Conn | 84/394 |
| 1,277,012 | 8/1918 | White | 84/394 |
| 1,662,076 | 3/1928 | Newman | 84/394 |
| 2,734,417 | 2/1956 | Hindsley | 84/394 |
| 2,738,696 | 3/1956 | Ritterbach | 84/394 |
| 3,161,103 | 12/1964 | Pascucci et al. | 84/394 |
| 3,433,114 | 3/1969 | Seme | 84/394 |
| 3,507,181 | 4/1970 | Cardwell | 84/388 |

FOREIGN PATENT DOCUMENTS

| | | | |
|---|---|---|---|
| 893000 | 7/1956 | Fed. Rep. of Germany | 84/394 |

*Primary Examiner*—Lawrence R. Franklin
*Attorney, Agent, or Firm*—Rogers, Eilers & Howell

[57] ABSTRACT

A pitch adjuster for a valved brass instrument having a tuning slide crook and a third valve slide crook enables play in the just intonation scale and includes a main push rod attached to the tuning slide crook, a finger operator attached to the third valve slide crook and slidably mounted on the main push rod, a bias spring retaining the finger operator in a normal position, a trigger operator and a detent assembly which provides for stopped flat and sharp positions. The trigger operator retracts the main push rod to retract the main tuning slide crook and sharpen the pitch of the note being played. The finger operator extends the main push rod and thereby extends the tuning slide crook and third valve slide crook to flatten the pitch of the note being played. The finger operator may be moved beyond the stopped position, by sliding along the main push rod and compressing the bias spring, and further extend the third valve slide crook alone. The detent assembly may be locked to disengage the pitch adjuster and a threaded tuning knob assembly permits adjustment of the relative position of the main push rod with respect to the tuning slide crook to thereby tune the instrument without affecting the pitch adjuster.

9 Claims, 10 Drawing Figures

PITCH ADJUSTER FOR VALVED BRASS INSTRUMENTS

BACKGROUND AND SUMMARY

Throughout the long history of music there have been numerous systems for selecting the pitch of various notes to comprise a basic scale for purposes of musical composition. The player of any musical instrument is concerned with but two of these systems. These are the scale of equal temperament and the scale of just intonation. The unit for measuring musical intervals is the cent; 1200 cents equalling an octave. In the scale of equal temperament, the octave of 1200 cents is divided into 12 equal parts and the interval between each note in the chromatic scale of equal temperament is 100 cents. From the 12 notes of the chromatic scale of equal temperament, various notes are selected to construct scales. The most basic of these to the music of the west is the diatonic 8 tone scale (7 different notes, the 8th being a repetition of the 1st). From a starting point, or keynote, the diatonic scale proceeds progressively through all the notes of the musical alphabet (A through G). The kind of diatonic scale is determined by its starting note and the resulting arrangement of whole notes and semitones.

While the scale of equal temperament is a man-made scale devised as a solution to the problem of tuning fixed tuned instruments, the scale of just intonation is a result of nature. The notes in the scale of just intonation are derived from the notes of the harmonic series or series of partial tones that comprise a musical note. The just, or pure, musical interval is the most consonant or agreeable arrangement possible of the notes contained in it. In the scale of just intonation the notes are unevenly spaced and are not always of the same pitch. For example, in the just major scale, the first and eighth notes coincide with the corresponding equal tempered note, the second note is +4 cents, the third note is −14 cents, the fourth note is −2 cents, the fifth note is +2 cents, the sixth note is −16 cents, and the seventh note is −12 cents different in pitch than the corresponding note in the scale of equal temperament.

For example, in the key of A major, A is the key note or first note in the scale and its pitch is chosen to coincide with the intonation of A in the scale of equal temperament. In the scale of G major and G natural minor, the note A appears in the second position (after the first note of G) and its pitch would be +4 cents above the pitch of an A in the scale of equal temperament. Similarly, in the key of F major, A is the third note in the eight note diatonic scale and its pitch would be −14 cents different from the note A in the scale of equal temperament. By extending this analysis further, it can be shown that the pitch of the note A should be adjusted to +16 cents (+ or −2 cents); −14 cents (+ or −2 cents); or 0 cents (+4 cents −2 cents) in order to achieve a full range of just intonation scales of varying keys wherein the note A appears at different steps within the diatonic scales. This is illustrated by Table 1.

TABLE 1

| Cents From "0" Point of the Equal Tempered Chromatic Scale | Scale Step Number | Scale Major And/Or Natural Minor | Pitch Position |
|---|---|---|---|
| +18 | 7 | Natural Minor | |

TABLE 1-continued

| Cents From "0" Point of the Equal Tempered Chromatic Scale | Scale Step Number | Scale Major And/Or Natural Minor | Pitch Position |
|---|---|---|---|
| +17 | | | |
| +16 | 3 | Natural Minor | + |
| +15 | | | |
| +14 | 6 | Natural Minor | |
| +13 | | | |
| +12 | | | |
| +11 | | | |
| +10 | | | |
| +9 | | | |
| +8 | | | |
| +7 | | | |
| +6 | | | |
| +5 | | | |
| +4 | 2 | Major & Natural Minor | |
| +3 | | | |
| +2 | 5 | Major & Natural Minor | |
| +1 | | | |
| "0" (Keynote) | 1 | Major & Natural | |
| −0 | | | |
| −1 | | | |
| −2 | 4 | Major & Natural Minor | |
| −3 | | | |
| −4 | | | |
| −5 | | | |
| −6 | | | |
| −7 | | | |
| −8 | | | |
| −9 | | | |
| −10 | | | |
| −11 | | | |
| −12 | 7 | Major | |
| −13 | | | |
| −14 | 3 | Major | − |
| −15 | | | |
| −16 | 6 | Major | |

Although the ear will readily accept imperfect melodic intervals (2 notes sounding one after the other), even the most untrained ear will detect imperfections in harmonic intervals (2 notes sounding simultaneously). Thus, a workable system of integrating the scale of equal temperament and the scale of just intonation is necessary for acceptable intonation in the playing of harmonic intervals. A workable system requires basing the just scales on equal tempered starting points, or key notes. This results in each note having ten different pitches as it occupies different scale steps in various major and naturally minor scales in which it appears. As there are 12 different notes and each note will have 10 different pitches (as the note A has) a total of 120 different pitches are required for the notes of the 12 major and 12 minor scales of just intonation. Thus, a pitch adjuster which would provide for one position of adjustment at +16 cents, and another position of adjustment at −14 cents would enable a valved brass instrument manufactured to play in the equal temperament scale to play all 120 pitches in the just intonation scale. The differences of +4 cents to −2 cents can be easily and comfortably compensated for by the player with virtually no loss in tone quality.

There have been some attempts at providing valved brass instruments with some adjustment to enable the player to correct for these differences in intonation, but none have been successful for various reasons. One problem is that there are deficiencies in virtually every instrument manufactured which result in trumpets being unable to reproduce even the equal tempered scale. Furthermore, most of the prior art devices are mechanical gadgetry which permit the player to selectively extend or retract a valve slide crook for either the first or third valve. However, these corrections only aid those notes played with valve combinations incorporating their related valve and none other. Furthermore, there is no teaching of stopped positions provided to aid the player and instead he must rely upon his "ear" to adjust the tuning as he plays.

Other devices have suggested that the main tuning slide may be manually adjusted during play but again, unsightly contraptions are used with no suggestion as to the proper stopped positions required to adjust various notes of the scale according to the key being played. Furthermore, there is no recognition of the problems caused by the scale of equal temperament and no teaching of stopped positions to enable an instrument to play in the scales of just intonation. Some prior art correction devices greatly complicate the otherwise simple tuning of the instrument as they are coupled to the tuning slide crook. These correction devices are unsightly, heavy, and do not incorporate structure to automatically extend the third valve slide in combination with the tuning valve slide as is required to correct certain low notes played on the instrument.

To solve these problems, applicant has succeeded in developing an elegantly simple pitch adjuster which is fully calibrated and provided with manual stops which can be preselected to automatically correct notes of the equal temperament scale and bring them very closely into "tune" with the just intonation scale to thereby permit the playing of the just intonation scale in any given key.

Applicant's pitch adjuster provides for the coordinated movement of the third valve slide and tuning slide crooks and stopped positions are provided at +16 and −14 cents. A trigger control is positioned for operation by the left thumb and a rotatable finger ring is provided for operation by the second or third finger of the left hand so as to easily operate the pitch adjuster as the instrument is being played. The detent or stopped positions are provided by a tuning element fastened to the main push rod and a stop post assembly with an extendable center post which contacts upraised shoulders and prevents movement of the main push rod beyond the stopped positions. The tuning element has a center trough which enables the stop post assembly to screw down and prevent movement of the main push rod, thus disengaging the pitch adjuster and provide for playing of the instrument in the equal temperament scale. The tuning of the instrument may be easily accomplished through use of adjusting knobs which are threaded on the main push rod and which are mounted directly to the tuning slide crook so that the position of the tuning slide crook may be adjusted relative to the main push rod. This also centers the pitch adjuster about the newly tuned position of the horn and ensures that the newly tuned horn will play in the just intonation scale accurately and not be affected by the tuning adjustments required for the particular player. Applicant's pitch adjuster will also provide the proper adjustment to eliminate the sharpness or flatness of the horn when played through a mute. These and other advantages may be more fully understood by referring to the drawings and description of the preferred embodiment that follows.

DETAILED DESCRIPTION OF THE PREFERRED EMBODIMENT

Figure 1:
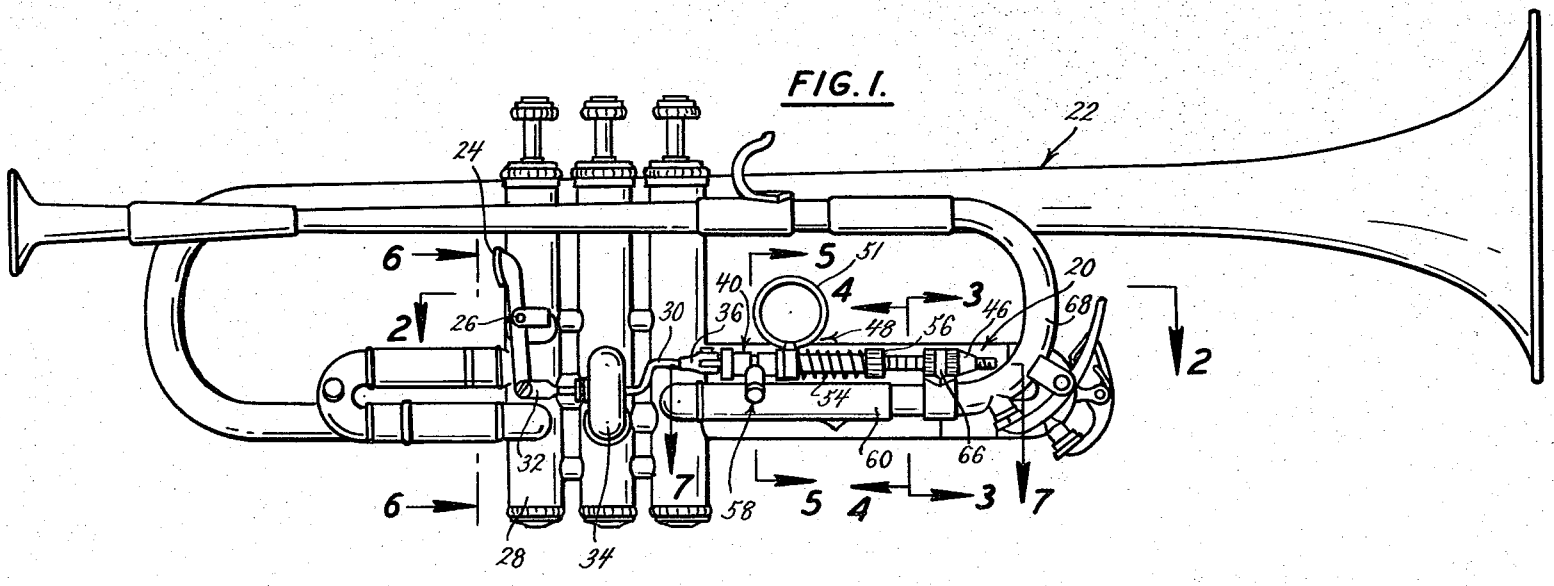
FIG. 1 is a side view of a trumpet with applicant's pitch adjuster mounted thereon.
Figure 2:
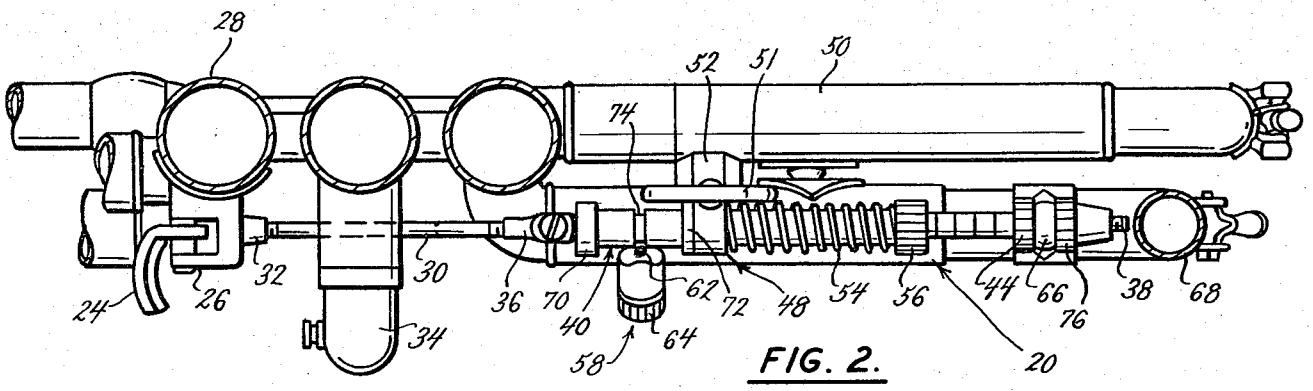
FIG. 2 is an enlarged cross-sectional view taken along the plane of line 2—2 in FIG. 1 with an overhead view of applicant's pitch adjuster.
Figure 4:
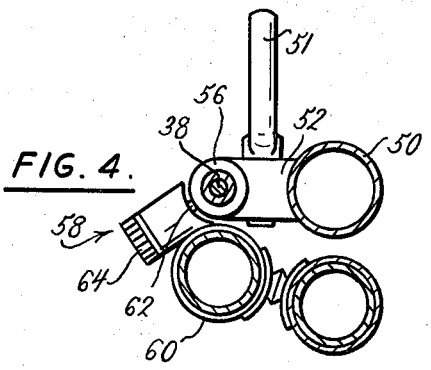
FIG. 4 is an enlarged cross-sectional view taken along the plane of line 4—4 in FIG. 1 and detailing the finger ring and stop post assembly.

Applicant's pitch adjuster 20 is shown mounted on a typical valved brass instrument, a trumpet 22, in FIG. 1 for purposes of illustration. However, it is to be understood that while the following description of the illustrations refers specifically to a trumpet, applicant's pitch adjuster 20 may be readily adapted to any valved brass instrument and is included within the scope of applicant's teaching. As shown in FIGS. 1 and 2, applicant's pitch adjuster 20 includes a trigger operator 24 which is positioned for operation by the thumb of the left hand as the player holds the trumpet 22. The trigger operator 24 is supported from the trumpet 22 by a pivot mount 26 about which the trigger operator 24 is free to move. The pivot mount 26 may be welded to the first valve 28 as shown. A connecting rod 30 is coupled to the trigger operator 24 by a coupling member 32 and extends through the second valve slide crook 34 which helps to protect it against any possible damage or interference with the player's grasp of the instrument. A coupling member 36 pivotally couples the main push rod 38 to the connecting rod 30, the main push rod 38 being threaded and having a series of elements threaded thereon as shown more particularly in FIG. 7. These include the tuning element 40, a spring retainer 42, a tuning knob 44, and an end knob 46 which is threaded onto the tuning knob 44. A finger ring operator 48 is welded to the third valve slide crook 50 and has a finger ring 51, and a collar member 52 which is slidably secured to the spring retainer 42 with a bias spring 54 extending between a shoulder 56 of spring retainer 42 and collar member 52. A stop pin assembly 58 is welded onto the main pipe 60 and has a stop pin 62 and locking nut 64 which adjusts the position of the stop pin 62 with respect to the tuning element 40. An end mount 66 is welded to the tuning slide crook 68 to secure the outer end of the main push rod 38 and provide for operation of the tuning slide crook 68 by the pitch adjuster 20.

Figure 7:
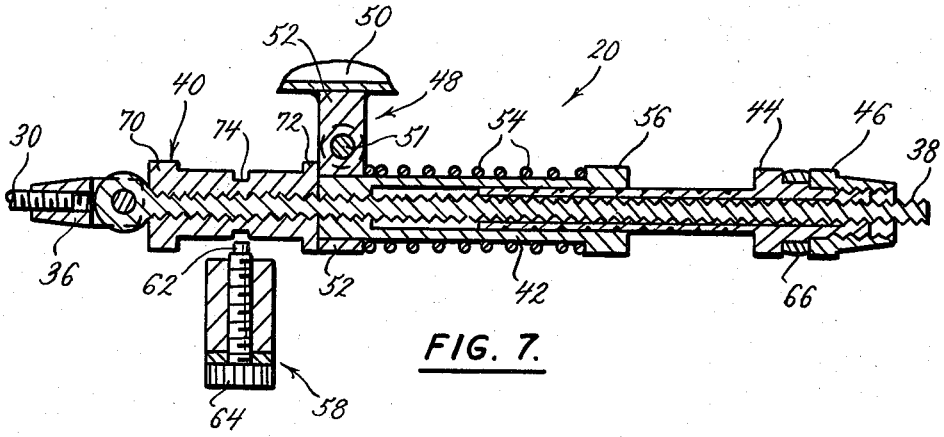
FIG. 7 is a cross-sectional view taken along the plane of line 7—7 and detailing the main push rod and parts threaded thereon.

As shown in FIGS. 2 and 7, the tuning element 40 has shoulders 70 and 72 which are aligned to contact stop pin 62 as the main push rod 38 is either retracted or extended to thereby limit the travel of the main push rod 38. A locking trough 74 is positioned in the approximate center of the tuning element 40 and receives stop pin 62 to lock the main push rod 38 and prevent its movement to thereby disengage the pitch adjuster 20 and permit the trumpet 22 to be played without operation thereof.

OPERATION

Applicant's pitch adjuster 20 is designed to mesh with the contour of the instrument 22 and avoid any interference with the grasping or playing of the instrument. As the right hand is principally involved with operating the valves, the operators 24, 48 are positioned for left hand operation. As best shown in FIG. 1, the pitch adjuster does not detract from the pleasing appearance of the instrument and is lightweight which prevents tiring of the player's arms or shoulders.

The pitch adjuster 20 is operated during the playing of the instrument to selectively "flatten" or "sharpen" or not affect the pitch of any note. With a little practice, this can be done as rapidly as the player moves from one note to the next by fingering the valves. There are essentially four operating positions. These include a center or null position which is best shown in FIG. 1 where stop assembly 58 is aligned with locking trough 74 and the pitch adjuster 20 does not alter the pitch of the note being played. In this position, stop assembly 58 may be "locked" into locking trough 74 to disengage the pitch adjuster and prevent any inadvertent adjusting of the pitch.

Figure 8:
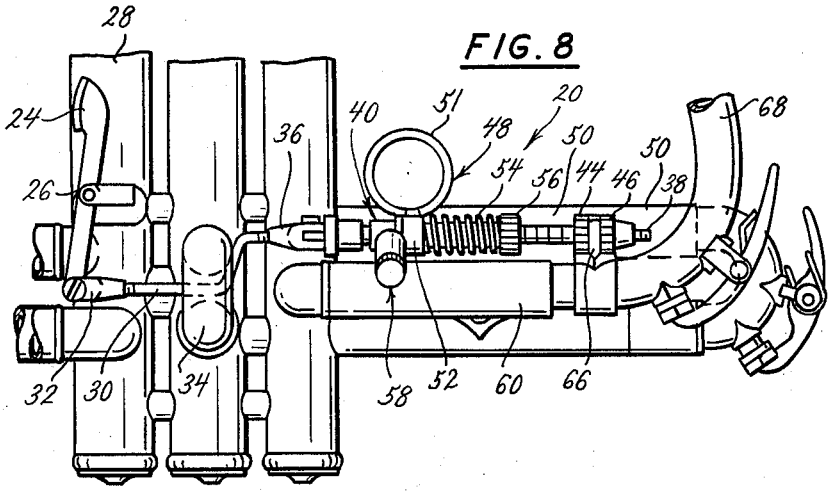
FIG. 8 is an enlarged partial view of applicant's pitch adjuster in the retracted or plus position.

FIG. 8 depicts applicant's pitch adjuster 20 in the fully retracted position which results from depressing the trigger operator 24 until the stop pin assembly 58 contacts the shoulder 72 of tuning element 40. At this position, the tuning slide crook 68 has been retracted and any notes played by the trumpet 22 will be "sharped" by a +16 cents over the same note which would result without operation of the pitch adjuster 20. It is noted that the third valve slide crook 50 remains in the fully in or closed position and does not move as the pitch adjuster 20 moves from the center position to the full in, plus, or sharped position.

Figure 9:
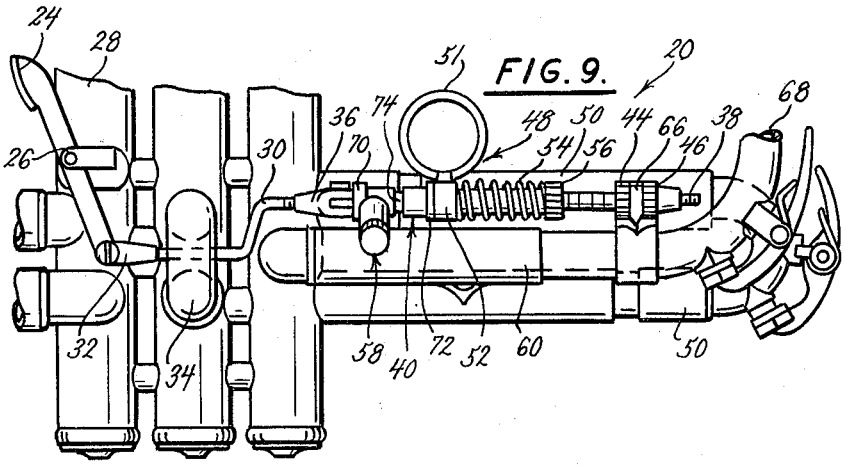
FIG. 9 is an enlarged partial view of applicant's pitch adjuster in the extended or minus position.

In FIG. 9, applicant's pitch adjuster 20 is shown in the fully out or "flatted" position as the stop pin assembly 58 has contacted the opposite shoulder 70 of the tuning element 40. This movement is accomplished by a player's second or third finger of his left hand applying pressure to the finger ring operator 48. In this position, the tuning slide crook 68 has been extended and the third valve slide crook 50 has been extended to lower the pitch of any note played by the trumpet 22 by approximately −14 cents over the same note when played without movement of the pitch adjuster 20.

Figure 10:
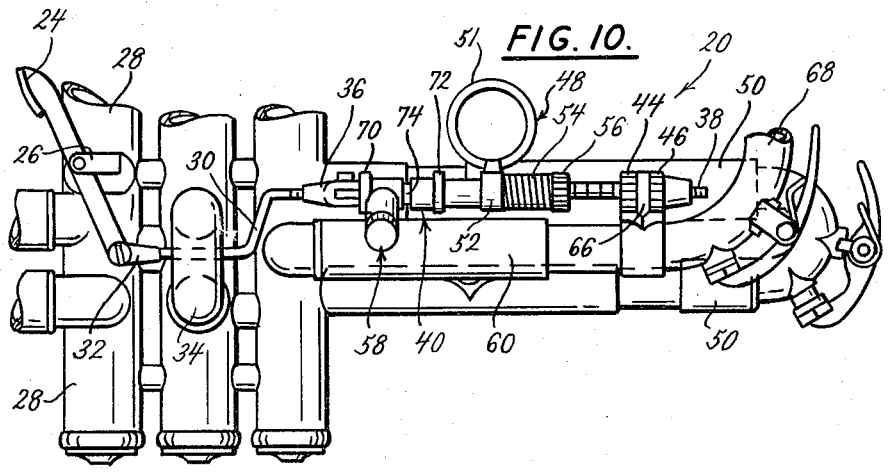
FIG. 10 is an enlarged partial view of applicant's pitch adjuster in the extended or minus position with an additional extension of the third valve slide crook.

As shown in FIG. 10, an additional extension of the third valve slide crook 50 only may be accomplished by further movement of the finger ring operator 48 such that the coller member 52 slides over the spring retainer 42 to compress bias spring 54 against shoulder 56. The stop pin assembly 58 prevents any further movement of the tuning slide crook 68 as it remains in engagement with shoulder member 70 of tuning element 40 and prevents movement of the main push rod 38 which is coupled to the tuning slide crook 68 by end mount 66.

Figure 3:
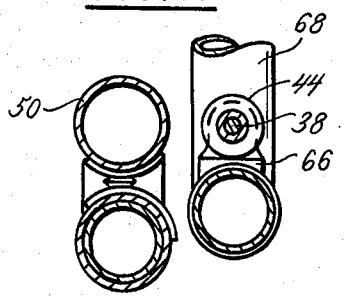
FIG. 3 is an enlarged cross-sectional view taken along the plane of line 3—3 in FIG. 1 and detailing the tuning adjustment for the tuning slide crook.
Figure 5:
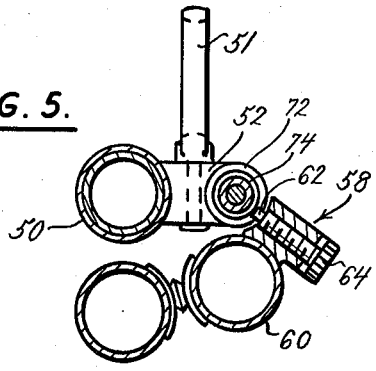
FIG. 5 is a cross-sectional view taken along the plane of line 5—5 in FIG. 1 and further detailing the finger ring and detent means with stop post assembly.
Figure 6:
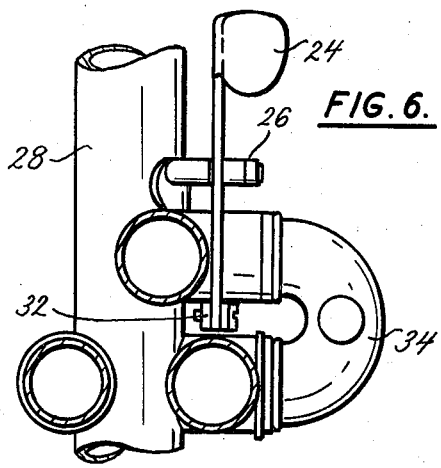
FIG. 6 is a cross-sectional view taken along the plane of line 6—6 in FIG. 1 and detailing the trigger operator and its mounting.

As shown in FIGS. 1, 2 and 7, tuning of the trumpet 22 may be easily accomplished independently of the pitch adjuster 20 and the pitch adjuster 20 automatically follows the tuning adjustments made so that the +16 cents and −14 cents range of adjustment becomes centered about the new tuning position of the tuning slide crook 68. As shown in the drawings, and as is known in the art, tuning of the trumpet 22 is accomplished by moving the tuning slide crook 68 either inward or outward which effectively lengthens the path of the vibrating air to thereby flatten or sharpen, respectively, the sound created by the trumpet 22. As applicant's pitch adjuster 20 is positively coupled to the tuning slide crook 68 by end mount 66, provision must be and has been made to move the tuning slide crook 68 with respect to the main push rod 38. This may be best accomplished by disengaging applicant's pitch adjuster 20 by screwing stop pin 62 into locking trough 74 which firmly secures main push rod 38 in its center or null position. Then, tuning knob 44 and end knob 46 may be rotated in tandem which advances or retracts that assembly about main push rod 38 as they are threaded thereon. This action also moves the tuning slide crook 68 as end mount 66 is captured between tuning knob 44 and end knob 46 and is also soldered directly to tuning slide crook 68, as is best shown in FIG. 3. Index lines and calibration marks 76 may be easily provided on tuning knob 44 and end knob 46 which provides for accurate positioning of the tuning slide crook 68 which is much more desirable than the typical adjustment provided by hand movement of the tuning slide crook 68 inwardly or outwardly by feel.

The third valve slide crook 50 is extended only when the pitch adjuster 20 is moved through the flatted or out position and affects only those notes played with use of the third valve, for example, C sharp and D. The extended third valve slide crook position aids in playing these two notes at their proper pitch for a just intonation scale. By combining the movement of the tuning slide crook 68 with the third valve slide crook 50, applicant's pitch adjuster 20 reduces by approximately 50% the required movement of the third valve slide crook 50 alone. Movement of the third valve slide crook 50 has been previously available on prior art trumpets 22 for "flatting" the C sharp and D low notes but applicant's pitch adjuster 20 significantly reduces the movement required of the second or third finger of the left hand to accomplish this adjustment.

Applicant's pitch adjuster 20 may also be used to compensate for muting of a trumpet 22 which may tend to flatten or sharpen the pitch of the note played, depending upon the type of mute used. For example, a cup mute typically flattens the resulting note and a standard mute typically sharpens the resulting note and applicant's pitch adjuster 20 provides a convenient way of compensating for play with either type of mute.

Changes and modifications may be made to applicant's device and would be apparent to one of ordinary skill in the art. These changes and modifications are included within the scope of applicant's teaching and applicant intends that his invention be limited only by the scope of the claims appended hereto.

I claim:

1. A valved brass instrument with a tuning slide crook with means for selectively adjusting the pitch of the note as the instrument is played including a main push rod, means connecting said main push rod to the tuning slide crook, means to controllably retract or extend said main push rod from a center position to thereby retract the tuning slide crook from its tuned position or extend the tuning slide crook from its tuned position, respectively, and adjustable detent means to limit the travel of said main push rod and provide a preselected retracted, center, and extended position, thereby enabling play in the just intonation scale, said adjustable detent having means to lock the main push rod in said center position for tuning.

2. A pitch adjuster for use on a valved brass instrument having a tuning slide crook, said pitch adjuster having means for selectively adjusting the pitch of the note as the instrument is played including a main push rod, means to connect said main push rod to the tuning slide crook, means to controllably retract or extend said main push rod from a center position to thereby retract the tuning slide crook from its tuned position or extend the tuning slide crook from its tuned position, respectively, and adjustable means to limit the travel of said main push rod and provide a preselected retracted, center, and extended position, thereby enabling play in the just intonation scale, said adjustable detent having means to lock the main push rod in said center position for tuning.

3. The device of claims 1 or 2 wherein the detent means includes a tuning element mounted on the main push rod and a stop pin assembly, said tuning element having shoulders for engaging the stop pin assembly to limit the extension and retraction of the main push rod, and said tuning elememt having a center trough, said stop pin assembly having means to engage said center trough and thereby prevent operation of the pitch adjustment means by prohibiting movement of the main push rod.

4. The device of claim 1 further comprising a first and second operator to move the main push rod, said first operator being connected to an end of the main push rod opposite the tuning slide crook and including a pivotally mounted trigger positioned for pressing by the left thumb to retract the main push rod, and said second operator being slidably mounted to the main push rod with a spring biasing said second operator into a first position and including a rotatably mounted finger ring positioned for extension by the second or third finger of the left hand.

5. The device of claim 1 wherein the instrument has a third valve slide crook and the main push rod is also connected to said third valve slide crook so that the third valve slide crook moves simultaneously with the tuning slide crook.

6. The device of claim 5 further comprising means to extend the third valve slide crook only beyond its preselected extended position.

7. The device of claim 6 wherein the third valve slide extension means includes a finger operator slidably mounted on the main push rod and fixedly secured to the third valve slide crook, and a spring biasing the finger operator so that when the detent means is in the extended position the finger operator may be slid along the main push rod thereby compressing the spring and further extending the third valve slide crook without extending the tuning slide crook.

8. The device of claim 1 further comprising means to adjust the position of the tuning slide crook with respect to the position of the main push rod to thereby tune the instrument with the pitch adjustment means becoming centered about the newly tuned position.

9. The device of claim 8 further comprising calibration means to measure and identify the position of the tuning slide crook with respect to the position of the main push rod.

* * * * *